US006139358A

United States Patent [19]

Cheng et al.

[11] Patent Number: 6,139,358

[45] Date of Patent: Oct. 31, 2000

[54] GROUND PLANE CABLE CONNECTOR ASSEMBLY

[75] Inventors: Ken Cheng, Santa Clara; Chih-Hsien Chou, San Jose; Eric Juntwait, Irvine, all of Calif.

[73] Assignee: Hon Hai Precision Ind. Co., Ltd., Taipei Hsien, Taiwan

[21] Appl. No.: 09/247,255

[22] Filed: Feb. 9, 1999

[51] Int. Cl.[7] ..... H01R 12/24

[52] U.S. Cl. ..... 439/497

[58] Field of Search ..... 439/497, 492, 439/77, 494, 493

[56] References Cited

U.S. PATENT DOCUMENTS

| | | | |
|---|---|---|---|
| 4,083,615 | 4/1978 | Volinskie | 439/494 |
| 4,422,700 | 12/1983 | Krenz | 439/497 |
| 4,619,487 | 10/1986 | Brush, Jr. | 439/497 |
| 4,679,868 | 7/1987 | Hasircoglu | 439/495 |
| 4,682,828 | 7/1987 | Piper et al. | 439/92 |
| 4,758,179 | 7/1988 | Klein et al. | 439/497 |
| 4,871,319 | 10/1989 | Babow | 439/77 |
| 4,971,574 | 11/1990 | Garcia | 439/497 |
| 5,174,782 | 12/1992 | Bogiel et al. | 439/404 |
| 5,697,807 | 12/1997 | Willey et al. | 439/493 |

*Primary Examiner*—Neil Abrams
*Assistant Examiner*—Hae Moon Hyeon
*Attorney, Agent, or Firm*—Wei Te Chung

[57] ABSTRACT

A cable assembly comprises a substrate forming first and second mating portions and a ground pad. A first connector is assembled to the first mating portion and a ribbon cable electrically connected to the first mating portion. A ground plane is assembled to the ribbon cable and electrically connected to the ground pad of the substrate at one end. A second connector is connected to another end of the ribbon cable. A metal tab electrically connected to ground terminals of the second connector at one end and electrically connected to the ground plane at another end.

7 Claims, 8 Drawing Sheets

GROUND PLANE CABLE CONNECTOR ASSEMBLY

FIELD OF THE INVENTION

The present invention relates to a cable assembly, and more particularly to a cable assembly having an enhanced grounding path to ensure high speed signal transmission.

DESCRIPTION OF PRIOR ART

Historically, cable assemblies and connectors within a computer transfer data at speeds which do not readily lead to signal degradation due to electromagnetic interference, such as impedance, skew, propagation delay, and crosstalk. However, as signal transmission speed increases, these phenomena can create severe problems within the computer system. Many efforts have been made to the cable assemblies and associated connectors to prevent the signal transmission from being adversely affected by those phenomena.

One typical measurement is using a ground plane assembled to the ribbon cable to shield the EMI. Even the ground plane does provide a shield to EMI, connections between the ground plane and the associated connectors have not yet been optimized. The existing ground plane is connected to one of the grounding wires of the ribbon cable and then is directed to other grounding position. Other ground wires in the ribbon cable are not electrically connected to the ground plane. Furthermore, the ground plane does not connect to an EMI shield associated to the connector.

SUMMARY OF THE INVENTION

An objective of this invention is to provide a ground plane cable assembly wherein ground signal wires and an EMI of an associated connector are connected to the ground plane thereby providing a complete EMI shielding performance.

In order to achieve the objective set forth, a cable assembly in accordance with one embodiment of the present invention comprises a substrate forming first and second mating portions and a ground pad. A connector is assembled to the second mating portion and a ribbon cable electrically connected to the first mating portion. A ground plane is assembled to the ribbon cable and electrically connected to the ground pad of the substrate at one end. A second connector is connected to another end of the ribbon cable. A metal tab is assembled to another end of the ribbon cable and electrically connected to ground terminals of the second connector. The metal tab is electrically connected to the ground plane at another end.

According to another embodiment of the present invention, a cable assembly comprises first and second connectors electrically connected by a ribbon cable. A ground plane is assembled to the ribbon cable. A first metal tab extends from an EMI shield assembled to one of the connectors and electrically connected to one end of the ground plane. A second metal tab opposite the first metal tab is assembled the ribbon cable. The second metal tab interconnects grounding terminals of the second connector at one end, and another end of the ground plane at the other end.

Yet, according to another embodiment of the invention, a cable assembly comprises first and second connectors electrically connected by a ribbon cable. A ground plane is assembled to the ribbon cable. The first connector is mounted to a substrate and electrically connected to a third connector mounted on the same board. The substrate includes a ground pad on which the ground plane split from the ribbon cable, is soldered. A jacket formed by an over-molding process covers both surfaces of the substrate for protectively shielding the connection between the ground plane and the solder pad.

These and additional objects, features, and advantages of the present invention will become apparent after reading the following detailed description of the preferred embodiments of the invention taken in conjunction with the appended drawing.

DETAILED DESCRIPTION OF PREFERRED EMBODIMENT

Figure 1A:
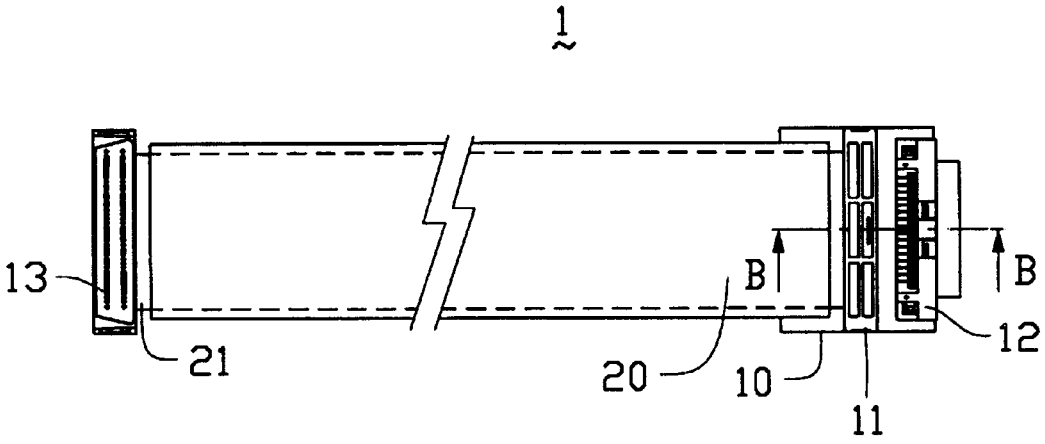
FIG. 1A is a top plan view of a first embodiment of a cable assembly in accordance with the present invention.
Figure 1B:
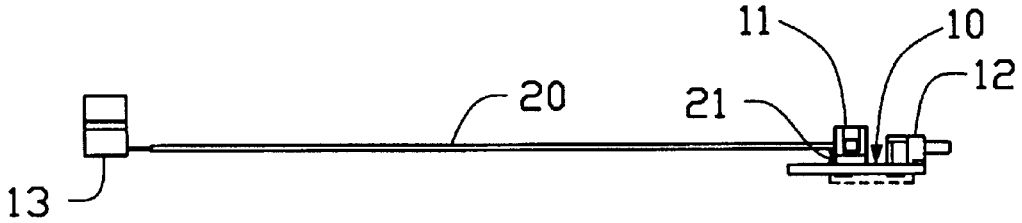
FIG. 1B is a side elevational view of FIG. 1A.
Figure 1C:
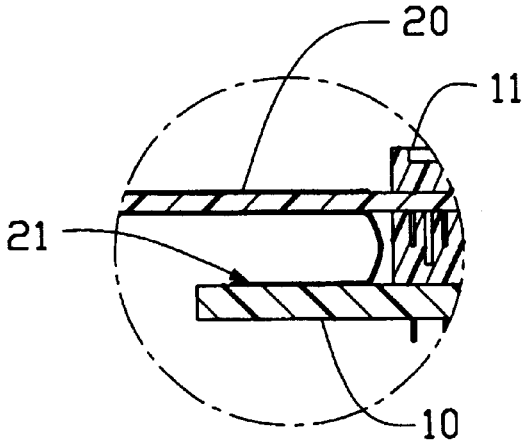
FIG. 1C is an enlarged view taken along line B—B direction of FIG. 1B.
Figure 1D:
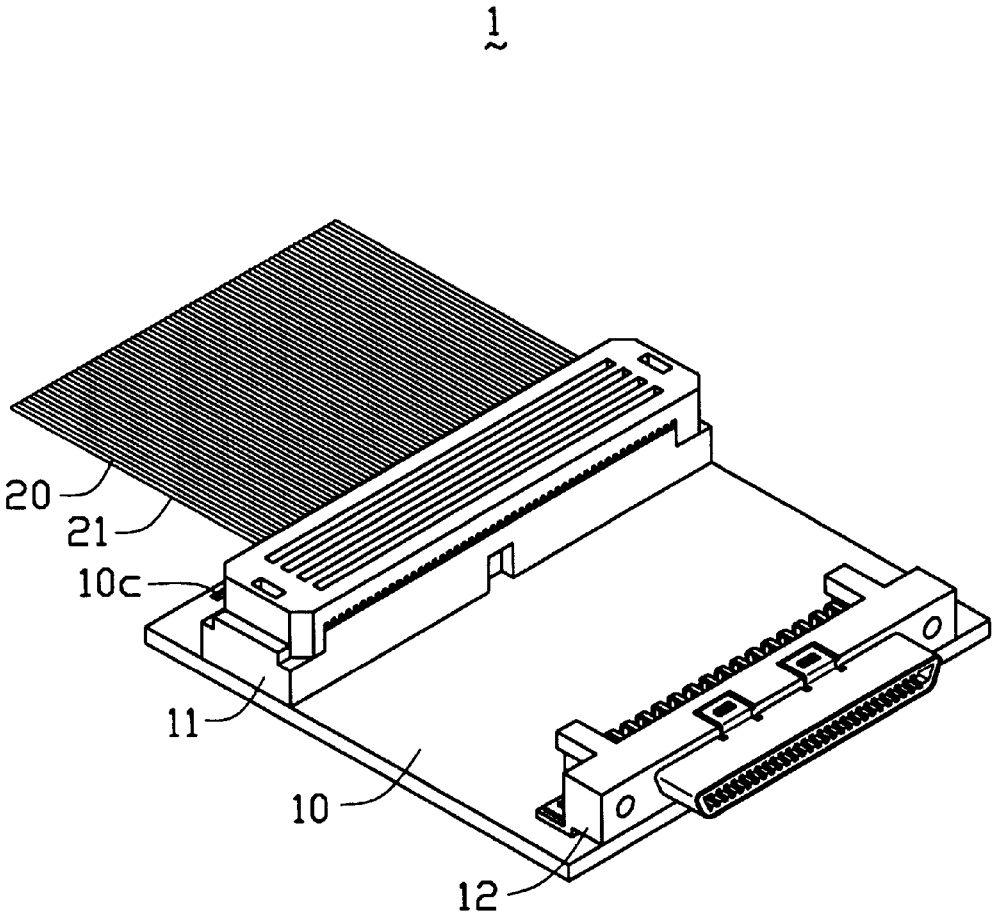
FIG. 1D is a perspective view of a first substrate of FIG. 1 on which two connectors are assembled, and a ground plane is connected to a ground pad thereof.
Figure 2A:
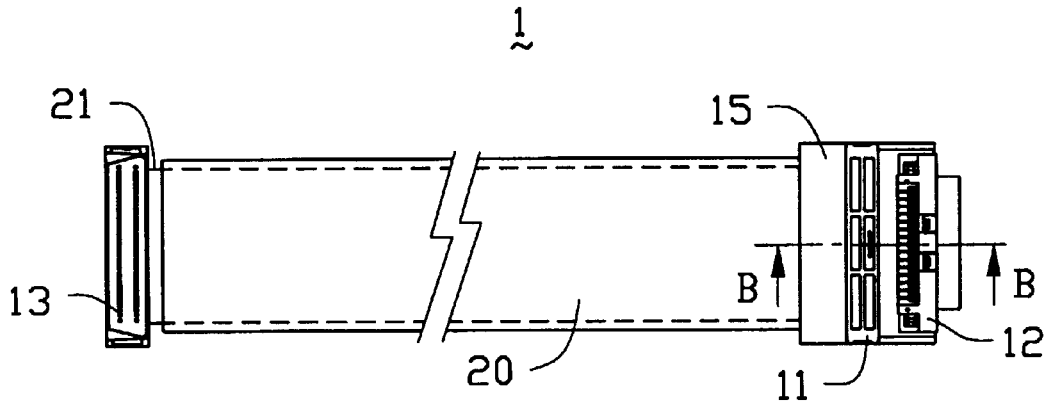
FIG. 2A is a top plan view of a cable assembly of FIG. 1A after over-molding.
Figure 2B:
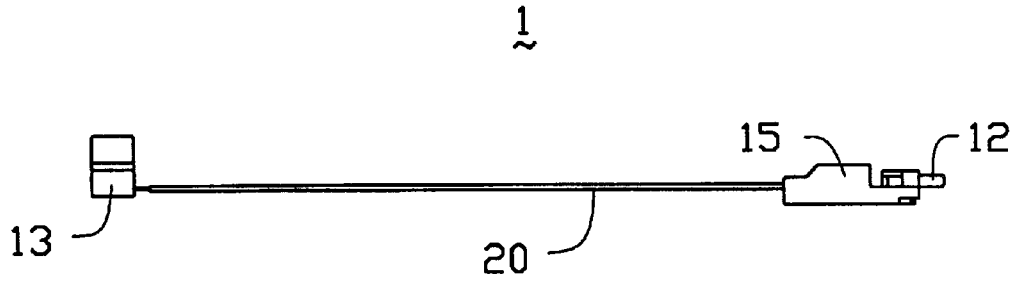
FIG. 2B is a side elevational view of FIG. 2A.
Figure 2C:
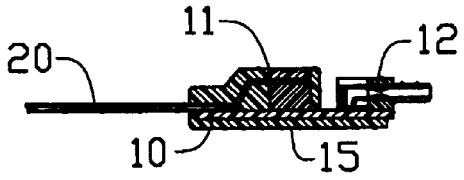
FIG. 2C is an enlarged view taken along line B—B of FIG. 2B.

Referring to FIGS. 1A, 1B, 1C, 1D, 2A, 2B, 2C and 3A, a cable assembly 1 in accordance with the present invention comprises a substrate 10 on which first and second mating portions 10*a*, 10*b* and a ground pad 10*c*. An IDC connector 11 and an Ultra SCSI connector 12 are assembled to the substrate 10. The connectors 11, 12 are electrically connected by leads (not shown) formed on the substrate 10. A ribbon cable 20 is terminated, with interior conductors (not shown) thereof, to the connector 11 at one end. The ribbon cable 20 includes a ground plane 21 attached thereto. The ground plane 21 is connected to a ground pad 10*c* formed on the substrate 10. Another end of the ribbon cable 20 is terminated to a second IDC connector 13 and the ground plane 21 is also connected thereto. The first IDC connector 11, the SCSI connector 12 and the substrate 10 are further enclosed with a plastic layer 15 by over-molding process.

Figure 3A:
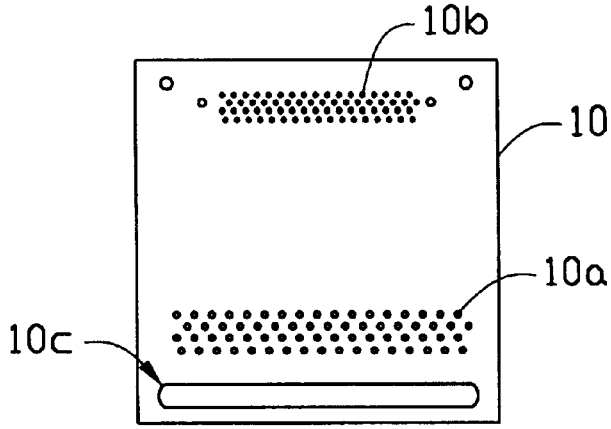
FIG. 3A is a top plan view of the first substrate of FIG. 1A.
Figure 3B:
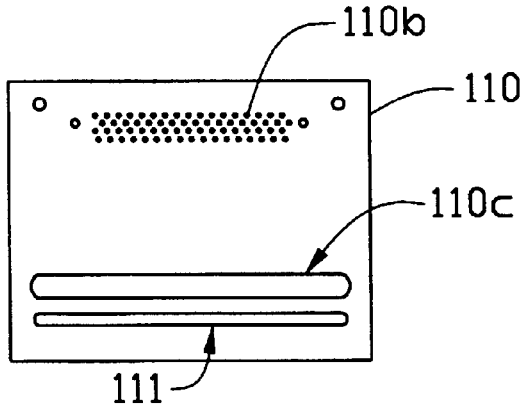
FIG. 3B is a top plan view of a second substrate in accordance with a second embodiment.

Referring to FIG. 3A, the substrate 10 in accordance with the first embodiment includes the first and second mating sections 10*a*, 10*b*, and the ground pad 10*c* to which the ground plane 21 is electrically connected. The IDC connector 11 is assembled to the first mating section 10*a* and the SCSI connector 12 is connected to the second mating section 10*b*.

Figure 4C:
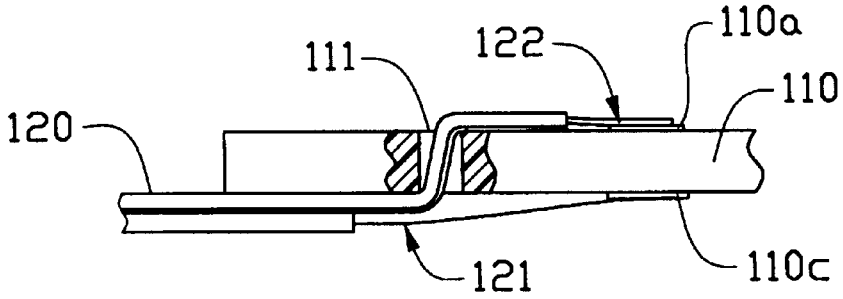
FIG. 4C is a partial, side view of the second substrate of FIG. 3B with a portion cut-away.
Figure 4A:
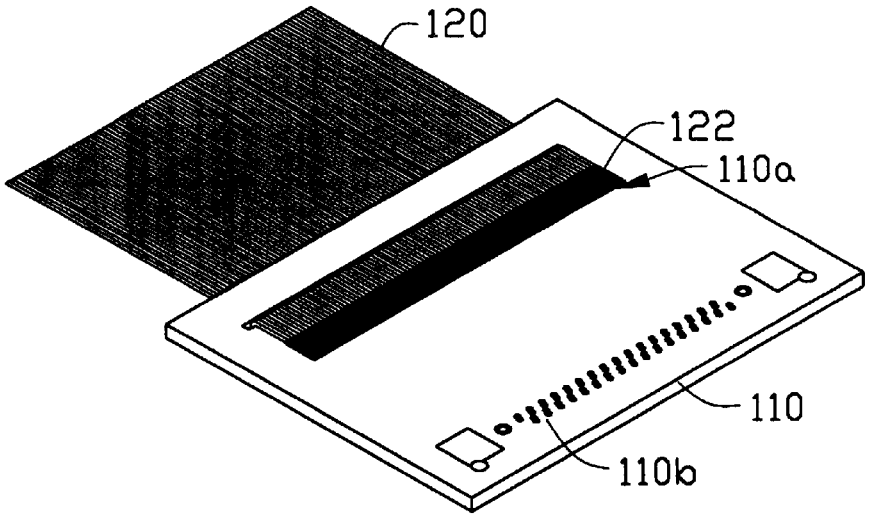
FIG. 4A is a perspective view of the second substrate of FIG. 3B with a ribbon cable assembled thereto.
Figure 4B:
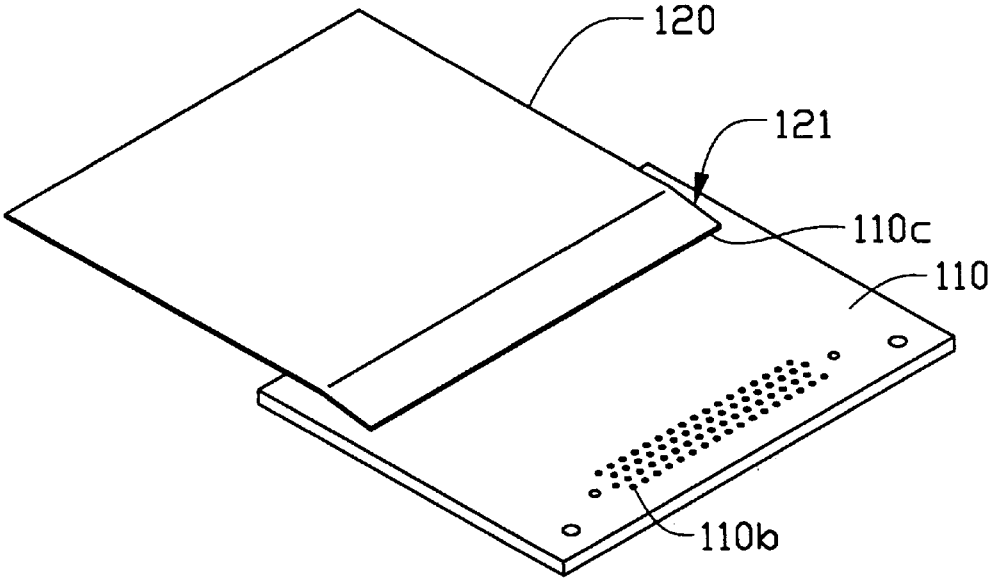
FIG. 4B is a perspective view of the second substrate of FIG. 3B viewed from a reverse angle.

Referring to FIGS. 3B, 4A, 4B and 4C, a substrate 110 in accordance with a second embodiment of the present invention comprises first and second mating sections 110*a* and 110*b*, a ground pad 110*c* and a strain relief embodied in a slot 111 therein. Referring to FIGS. 4A, 4B and 4C, in assembly a ribbon cable 120 and a ground plane 121 are separated firstly. The ribbon cable 120 then passes through the slot 111 while the ground plane 121 is connected to the ground pad 111*c* and conductors 122 of the ribbon cable 120 are connected to the first mating portion 110*a*. When the ribbon cable 120 extends through the slot 111, an outer surface of the ribbon cable 120 abuts against a lower edge of the slot 111 thereby preventing the connections between the conductors 122 of the ribbon cables 120 and the first mating section 110*a* from suffering excessive pulling force.

Figure 5A:
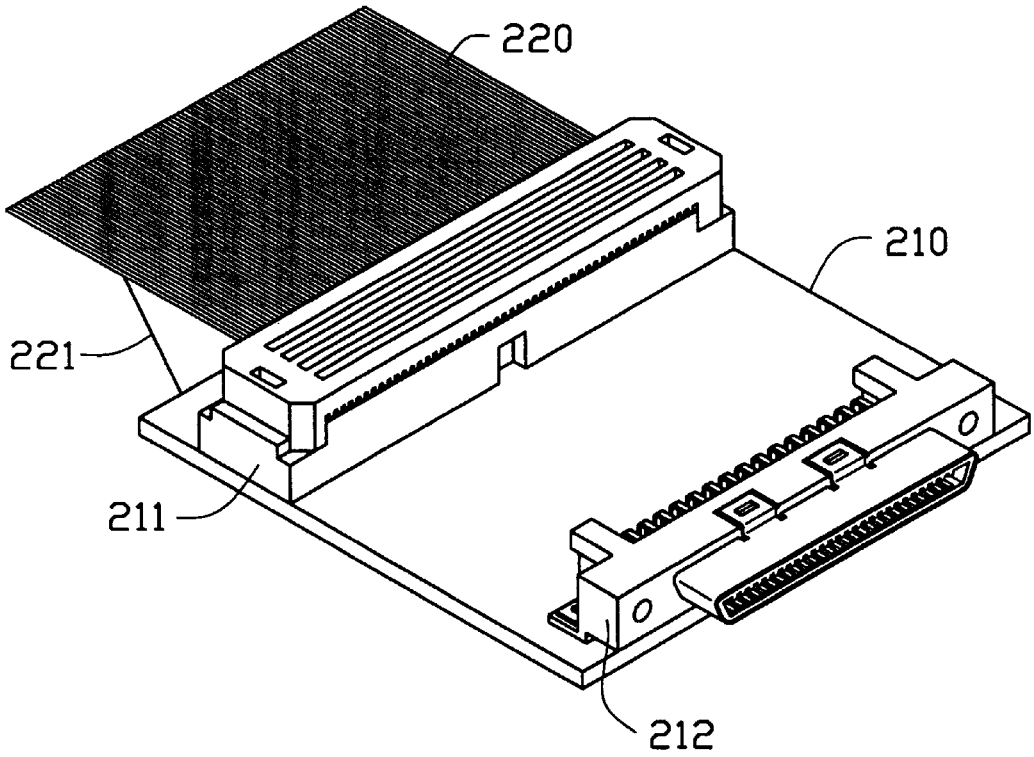
FIG. 5A is a perspective view of the third substrate with a ribbon cable assembled thereto according to a third embodiment.
Figure 5B:
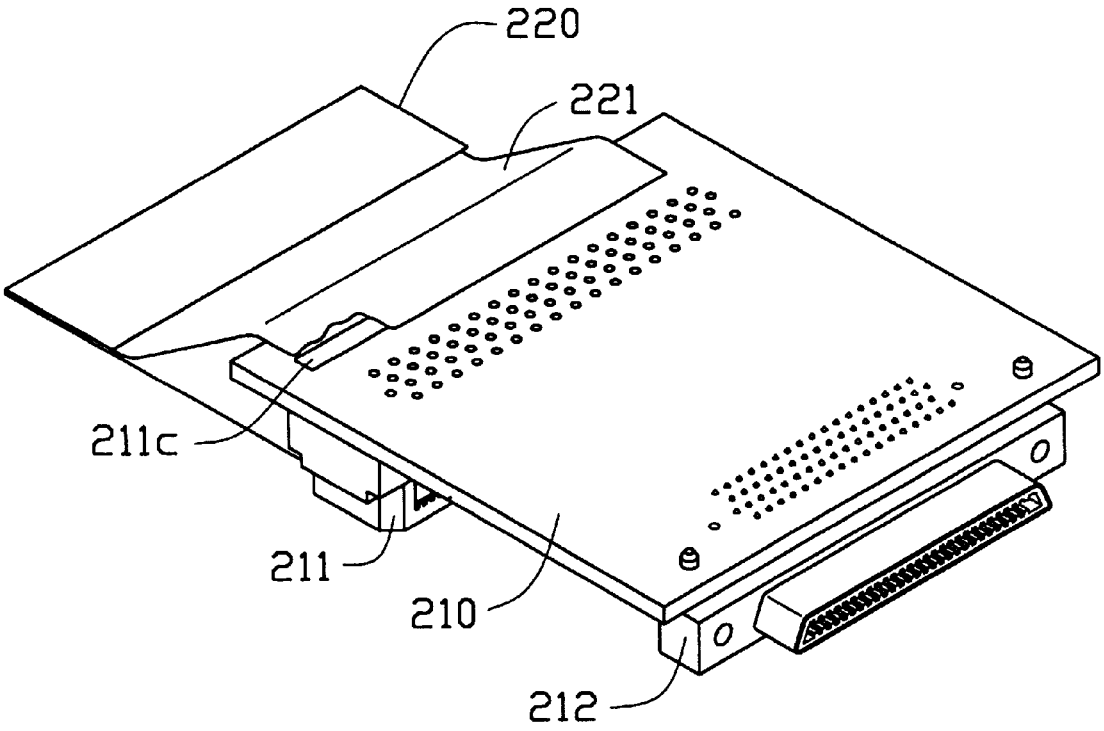
FIG. 5B is a perspective view of FIG. 5A viewed from a reverse angle.

Referring to FIGS. 5A and 5B which disclose a third embodiment and also a variation of the first embodiment, a ground pad 211*c* is formed a bottom face of the substrate 210. An IDC connector 211 and a SCSI connector 212 are assembled to a top face. As a result, a ground plane 221 of a ribbon cable 220 is assembled the bottom face of the substrate 210.

Figure 6A:
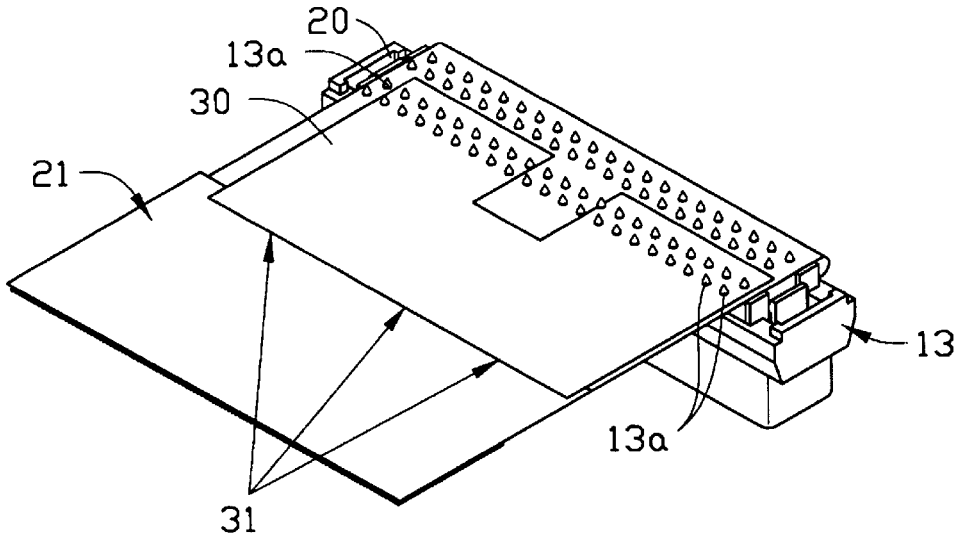
FIG. 6A is a perspective view of an IDC connector of FIG. 1A with a ribbon cable terminated thereto.

Referring to FIG. 6A, a metal tab 30 is used to connect the ground plane 21 to the second IDC connector 13. The metal tab 30 is deployed with a layer of adhesive and attached to the ribbon cable 20. When the ribbon cable 20 is terminated to the insulative displacement sections 13*a* of the second IDC connector 13, the metal tab 30 is also terminated thereto. Then another end of the metal tab 30 is electrically soldered to the ground plane 21 along an end edge 31 thereof.

Figure 6B:
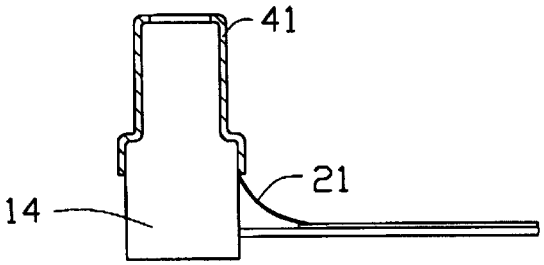
FIG. 6B is a cross sectional view of an IDC connector with a metal tab retained between a housing and an EMI shield according to a fourth embodiment.
Figure 6C:
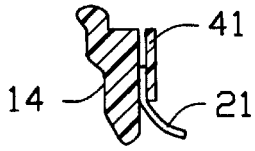
FIG. 6C is an enlarged view encircled in FIG. 6B.

FIGS. 6B and 6C disclose a fourth embodiment of another arrangement for connecting the ground plane 21 to an EMI shield 41 of an IDC connector 14. One end of the metal tab 30 is retained between an outer wall of a housing of the connector 14 and an inner wall of the EMI shield 41. The other end of the ground tab 30 is then soldered to the ground plane 21 similar to FIG. 6A. By this arrangement, grounding paths become the ground plane 21 and the associated connectors 12, 13 or 14 are preferably established.

The invention discloses the method of connecting the ground plane to the corresponding connector. For the first connector which is at one end of the cable and mounted on a substrate, an elongated strip type ground pad is formed on the at least one of the two opposite surfaces of the substrate so that a front edge portion of the ground plane which is split from the ribbon cable, can be solderably mounted thereon, and a jacket is formed thereon by overmolding for protectively shielding the connection between the ground plane of the ribbon cable and the ground pad of the substrate. Differently, for the connectors which is at the other end of the cable opposite to the first connector mounted, the ground plane can be directly terminated to the corresponding contacts or directly engaged with the EMI shield of the connector. Understandably, the feature of the invention is to provide the strip type ground pad formed on at least one surface of the substrate parallel to the connector mounted on the same substrate wherein the front edge portion of the ground plane is split from the ribbon cable and soldered on the ground pad and the remaining ribbon cable is electrically connected to said connector.

While the present invention has been described with reference to specific embodiments, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A cable connector assembly, comprising:

a ribbon cable including a ground plane thereof;

a first connector electrically connected to one end of the ribbon cable;

a substrate defining two opposite surface on one of which the first connector is connected, said substrate including a strip type ground pad extending parallel to the first connector and being positioned on the opposite surface with regard to the first connector, wherein a front edge of one end of the ground plane is split from the ribbon cable and soldered on said ground pad.

2. The cable connector assembly as described in claim 1, wherein a jacket is applied to the substrate to protectively shield connection between the ground pad and the ground plane.

3. The cable connector assembly as described in claim 1, wherein a second connector is seated on the substrate and electrically connected to the first connector.

4. A cable connector assembly comprising:

a ribbon cable including a ground plane;

a connector mechanically and electrically connected to one end of said ribbon cable, said connector including a housing and a shield wherein the ground plane is electrically connected to said shield, and a metal tab being attached to one end of said ground plane and sandwiched between said shield and said housing for performing mechanical and electrical connection between the connector and the ground plane.

5. A cable connector assembly comprising:

a ribbon cable including a ground plane thereof;

a substrate defining first and second surfaces with a ground pad and a mating portion respectively thereon; and a strip type slot extending through the substrate in a vertical direction wherein conductors of the ribbon cable move from the first surface to the second surface by extending through said slot and are electrically connected to said mating portion on the second surface, while the ground plane which is split from the ribbon cable, stays with the first surface for connecting to the ground pad on the first surface.

6. A cable connector assembly, comprising:

a substrate defining first surface, a strip type ground pad formed on near an edge of said first surface;

a ribbon cable including a ground plane integrally disposed thereunder, an edge of said ground plane being electrically soldered to said ground pad; and a first connector electrically mounted on one of said surface at one end and electrically terminated to one end of the ribbon cable at the other end in a manner such that said soldered edge of said ground plane is located between said ribbon cable and said substrate.

7. The cable connector assembly as described in claim 6, wherein the ground pad is positioned on the same surface of the substrate with the first connector.

* * * * *